US007311279B2

(12) United States Patent
Parke

(10) Patent No.: US 7,311,279 B2
(45) Date of Patent: Dec. 25, 2007

(54) SELF CLEANING SHREDDING DEVICE HAVING MOVABLE CLEANING RINGS

(75) Inventor: Terrence James Parke, deceased, late of Melton (AU); by Karen Mathers, legal representative, Melbourne (AU)

(73) Assignee: Terrance James Parke, Melton, Victoria (AU)

( * ) Notice: Subject to any disclaimer, the term of this patent is extended or adjusted under 35 U.S.C. 154(b) by 0 days.

(21) Appl. No.: 10/470,510

(22) PCT Filed: Jan. 29, 2002

(86) PCT No.: PCT/AU02/00084

§ 371 (c)(1),
(2), (4) Date: Apr. 19, 2004

(87) PCT Pub. No.: WO02/060588

PCT Pub. Date: Aug. 8, 2002

(65) Prior Publication Data

US 2005/0040263 A1 Feb. 24, 2005

(30) Foreign Application Priority Data

Jan. 29, 2001 (AU) ..... PR2747

(51) Int. Cl.
*B02C 1/08* (2006.01)
*B02C 7/04* (2006.01)
*B02C 13/20* (2006.01)

(52) U.S. Cl. ..... 241/166; 241/167; 241/236; 241/DIG. 31

(58) Field of Classification Search ..... 241/166, 241/167, 236, 292.1, 293, 294, DIG. 31
See application file for complete search history.

(56) References Cited

U.S. PATENT DOCUMENTS 4,560,112 A * 12/1985 Rouse et al. ..... 241/236
4,932,596 A * 6/1990 Sullivan et al. ..... 241/236
5,516,050 A * 5/1996 Yamamoto et al. ..... 241/167
5,636,801 A * 6/1997 Kroger ..... 241/167
6,390,400 B1 * 5/2002 Huang ..... 241/295
6,644,570 B1 * 11/2003 Irwin ..... 241/18

* cited by examiner

*Primary Examiner*—Bena Miller
(74) *Attorney, Agent, or Firm*—Dinsmore & Shohl LLP

(57) ABSTRACT

A self cleaning cutting assembly is provided, having an array of counter rotating cutters in which a plurality of cutters rotating in a first direction are mounted on a first shaft and a plurality of second cutters are mounted on a second shaft for rotating in an opposite direction. The array of cutters is provided with a plurality of clearing or cleaning rings located alternately with the cutters on each shaft. The cutting array is kept clear of debris or partially cut material by movement of the clearing or cutting rings against adjacent cutters. Movement of the clearing or cleaning rings is a combination of rotary motion and linear motion, in which the linear motion is imparted by the cutter located opposite the cleaning ring striking the cleaning rings so as to push the cleaning ring beyond the position of the widest part of the cutter to completely dislodge material from the cutter.

33 Claims, 4 Drawing Sheets

SELF CLEANING SHREDDING DEVICE HAVING MOVABLE CLEANING RINGS

The present invention relates generally to machinery, devices or installations used in the material treatment industries, particularly in the recycling and waste disposal industries. In particular the present invention relates to apparatus, appliances and assemblies that may be used to cut, crush, pulverise, comminute or otherwise reduce in size a wide variety of different materials, particularly waste or scrap materials, so as to convert the waste or scrap materials into a size which is more usable or useful, such as for example, for use in further processing in the manufacture of recycled goods or of a size which is easier to dispose of or of a size for more advantageous final disposal of the waste or scrap material, either in land fill, for recycling or for consumption, such as a fuel or the like. Even more particularly the present invention relates to an apparatus or device provided with a cutting assembly having one or more cutting elements arranged in cutting arrays or similar for reducing the size of materials in which the arrays are provided with self-cleaning or self-clearing means, particularly associated with the cutting elements. Even more particularly, the present invention relates to a shredding device, particularly for shredding used motor vehicle tires, in which the cutting assemblies comprise cutting elements and spacers arranged in opposed sequences so that as the cutting elements rotate to shred the material the cutting elements are cleared or cleaned by movement of the spacers, particularly movement which is essentially eccentric, preferably rotary movement combined with linear movement in accordance with rotation of the cutting elements and contact by the cutting elements. The cutting means, assemblies or sequences including the cutting elements are arranged in opposed arrays to cooperate with each other to sever material located between respective cutters as they rotate with respect to each other, particularly in opposite directions to each other. One particular application of the device of the present invention relates to an apparatus or device having rotary cleaning rings located alternately with rotary cutters for cleaning the cutters when the device is used for reducing the size of scrap materials such as for example, used motor vehicle tires or the like so that the shredded material may be used in other applications, such as for example, as a fuel in furnaces, particularly furnaces for producing cement, power or the like, as a filler in paving or road construction materials, such as for example, in forming rubberised footpaths or walkways of the type used in theme parks, recreational areas or the like.

Although the present invention will be described with particular reference to one cutting assembly in the form of a shredder for use in shredding used motor vehicle tires in which the shredder has a plurality of cutters and spacer rings arranged alternately in rows to form an array in which the cutters are kept clean by rotation of the spacer rings with respect to the cutters, it is to be noted that the present invention is not restricted in scope to the described embodiment or to the described use or described application but rather the present invention is broader in scope so as to include other forms and arrangements of the cutting assemblies, including their use in other devices, other uses of all of the different assemblies, devices and arrangements, including treatment of other materials to produce relatively smaller sized particles in a variety of different sizes, shapes or forms.

It is to be noted that even though the present invention will be described with particular reference to cutting or severing material by the cutters, the scope of the term cutting, cutting elements or cutters is not limited to cutting but includes any operation whereby material is reduced in size such as by crushing, slicing, pulverising or the like.

One problem of existing cutting devices and shredders used in recycling waste or scrap materials for reducing the size of the scrap material or waste material to relatively smaller sized particles is that the strips of material formed as part of the size reduction operation have a tendency to wrap around the cutting assemblies or arrays so as to become wound around and/or entangled in the cutters and shaft on which the cutters are mounted during operation of the device which has the effect of reducing the efficiency of cutting of the machinery or even stalling the machinery if there is an excessive build-up of strips of severed material around the cutters and shafts. Previous attempts at providing mechanisms or means for preventing material wrapping around the cutters or becoming lodged in the cutting assembly or clearing severed material away from the cutters, have not been entirely successful for a variety of reasons. Thus, it is one aim of the present invention to provide a shredding device that has an effective anti-wrapping arrangement for reducing or preventing the amount of material which wraps around the cutting elements and/or shafts to become entangled within the cutting arrays and shafts during use of the cutting device.

Another problem of existing shredding devices is that the cutters become clogged with partially cut material that adheres to the cutters. The pressure of partially shredded or shredded material on or around the cutters reduces their efficiency.

Another problem associated with existing shredding devices is that the cutting surfaces of the cutting elements become blunt within a very short period of time by being in constant contact with each other which accelerates the wear of the cutting surfaces and edges. When the cutting surfaces or edges become blunt it is necessary to disassemble the array of cutters and sharpen each cutter individually and assemble the array ready for reuse. One reason for the cutting edges or surfaces becoming prematurely blunt is that such cutters are not provided with any self cleaning or self sharpening mechanism to prolong the useful working life of the cutters. The accumulation of debris from severed material between the cutters accelerates the rate of wear of the cutters.

Another reason for existing cutting assemblies becoming prematurely blunt is that foreign objects contaminating the feed material could become trapped between the cutters so that the foreign objects are continually being struck by the rotating cutters of the cutting assembly such as by the foreign objects becoming wedged between adjacent cutters and/or between the cutters and shafts since there was no effective mechanism provided to clean or clear the cutters of such objects. Again, the wear caused by this situation is accelerated by strips of material being wound around the shafts and/or cutters. In some cases the cutting devices are damaged by the foreign objects, whilst in others the cutting devices stall.

Thus, there is also a need for a cutting device which is self sharpening during use in order to prolong the useful working life of the cutters by lengthening the periods between sharpening of the cutters.

Thus, there is a need for a cutting device that has a cutting assembly of individual cutters which is self clearing or self cleaning. The terms self clearing and self cleaning are used interchangeably herein and refer to cutters, cutting devices, and cutting assemblies that avoid the aforementioned problems. There is a further need for the cutting assembly being self sharpening. There is a still further need for the cutting assembly to be self-releasing or being provided with an arrangement that allows foreign objects to more or less pass safely through the cutting arrays without causing excessive damage to the cutters and/or which reduces the chances of the cutting assembly stalling or stopping.

Thus, it is one aim of the present invention to provide a self clearing and/or self cleaning cutter. It is another aim to provide a cutting assembly which has a longer working life by preventing premature wear of the cutting surfaces of the cutters. It is a still further aim to provide a cutting assembly which is provided with a self sharpening arrangement for the cutters.

SUMMARY OF THE INVENTION

According to the present invention there is provided a self cleaning cutting assembly, particularly a cutting assembly adapted for use with a shredding device for shredding material into relatively smaller sized pieces, including:

a first cutting means capable of undergoing a first movement;

a second cutting means capable of undergoing a second movement; and a cleaning means capable of undergoing a third movement.

wherein said first and second cutting means are located substantially adjacently opposite each other so that material introduced into the cutting assembly between the first and second cutting means is cut by the cooperative interaction of the two cutting means with each other to produce the relatively smaller sized pieces of material, said cleaning means being located adjacent the first cutting means so that movement of the first cutting means imparts a first component of the movement to the cleaning means and substantially opposite said second cutting means so that when said second cutting means moves the second cutter means can contact the cleaning means to impart a second component of the movement of the cleaning means wherein the third movement of the cleaning means is a combination of at least the first and second components of movement imparted by the first and second cutter means, whereby movement of the cleaning means with respect to the first cutter means caused by contact from the second cutter means maintains the first cutter means in a condition substantially free of the severed relatively smaller size pieces of material thereby reducing or substantially eliminating the relatively smaller sized pieces of material from interfering with or disrupting operation of the first cutter means by wrapping around or remaining in contact with the first cutter means during use of the cutting assembly so that movement of the cleaning means provides self cleaning of the cutting assembly.

Typically the cutting assembly of the present invention is a shredding machine or shredding device. More typically the shredding device shreds material into elongate strips of material. Even more typically the elongate strips of material have a regularly repeating profile or shape, and are typically curved out of the plane containing the lengthwise extending axis of the material. Even more typically, the shredded pieces have a tendency to curl or wrap around the cutters, particularly due to the shape of the shredded pieces being curved or similar, particularly curved about their lengthwise axis.

Although one preferred material being treated by the shredder of the present invention is rubber or other resilient material, such as for example, from used motor vehicle tires, including heavy duty truck and bus tires, it is to be noted that the present invention can be used to cut or comminute material of any type.

Typically the cutting means is a rotary cutting blade arrangement, typically having one or more cutting surfaces located around the periphery of the blade. More typically, the outer cutting surface of the blade is provided with surface irregularities or discontinuities, such as for example, projections and troughs in the form of teeth, grooves, cleats or the like. More typically, the cutting surface is provided with a retaining means or holding means. Typically the retaining means is a hook, enlarged teeth, projection, spear head or tip or the like. More typically there are two, three, four or more such projections located at regularly spaced apart intervals around the circumference of the cutting surface. More typically, the cutting surface comprises three parts, two cutting edges or sections located at or towards the sides of the blades and a central section located between the side sections. More typically, the holding means is located in or about the central section.

Typically there is a plurality of rotating blades arranged to extend in a line or row of similar blades. Typically, the blades rotate in unison.

Typically the first movement of the first cutter is a rotation. Typically the second movement of the second cutter is a rotation. Even more typically the direction of rotation of the first cutter is opposite to the direction of rotation of the second cutter. More typically the first and second cutters rotate in opposite directions at the same speed and in unison with each other. Alternatively, the two rows of cutters can rotate at different speeds. The speeds of rotation can be variable.

Typically, all the cutters are mounted on shafts. More typically, there are two shafts, each shaft having a plurality of cutters. Even more typically, the cutters on each shaft are all the same size. Alternatively, the cutters on the one shaft can be of different sizes. Even more typically, the cutters differ in widths. Typically, there are cutters of two or three sizes mounted on the one shaft. More typically, there are different cutting zones defined by the different sized cutters. More typically, the cutters located substantially opposite each other are of the same size as each other so as to define different zones of the cutting array. More typically, there is a first zone of cutters in which the cutters are about 100 mm in width, typically there is a second zone of cutters in which the cutters are about 70 mm in width, and typically there is a third zone of cutters in which the cutters are about 40 mm in width. The cutters are readily replaceable on the shafts. Typically, the cutters are replaceable in blocks in accordance with their wear.

Typically the clearing or cleaning means is a spacer. Typically the spacer is a ring arrangement. More typically the spacer is a simple ring having a reinforcing internally located radially directed flange and an outer circumferential surface. Even more typically, the ring is of a complex structure having one or more inner ring portions, preferably provided with a flange arrangement, an intermediate ring portion, preferably of a material having different mechanical properties or characteristics or an outer ring portion surrounding the intermediate portion.

Typically, the third movement is an eccentric movement being a combination of rotation and linear movement. More typically, the linear movement is longitudinal or transverse movement in a radial direction or tangential direction. More typically, movement of the spacer ring against one or more cutters cleans and/or clears the cutter or cutters and prevents cut pieces or strips of material from remaining against or being associated with the cutter or cutters or being adhered to the cutters. Even more typically, the linear movement, typically radial movement, is superposed on the rotary movement of the ring two, three, four or more times each revolution of the spacer ring.

Typically, the projection of the second cutter means strikes the outer surface of the ring to move the ring with respect to the first cutter to clean or clear the first cutter. More typically, the outer surface of the spacer ring is struck by the tip of the projection of the cutter or the like. Even more typically, the linear movement of the ring is such that the ring extends beyond the tip of the projection so as to push the material away from an adjacent cutter so as to completely clean the cutter.

Typically the spacer ring is not driven by the driving shaft but rather is driven by contact with the first cutter located opposite the ring, or by the cutters on either side of the spacer ring in combination with contact by the oppositely located cutter.

Typically, movement of the spacer is against or along the sides of the cutter so that the movement with respect to the cutter cleans material from the cutter, particularly the cutting surfaces of the cutter, and prevents any severed piece of material from wrapping around the cutter as it rotates by knocking the severed material away from the cutter. More typically, the extent of movement of the spacer is sufficient to dislodge any material adhering to the cutter.

Typically, the spacer ring is provided with a wear surface or wear portion. More typically, the wear surface is a ring, either a complete ring or a partial ring, located at or towards one or both sides of the spacer ring. Even more typically, the wear ring is metallic or is a resilient material made from a foam material, or is a plastically deformable material. Even more typically, the foam material is a sound deadening material for reducing the noise of impact of or against the cutters. Even more typically, the wear portion is made from the same material as the spacer ring or from a material which is more durable or harder than the spacer ring.

Typically, the device of the present invention is provided with a recycling assembly for returning items back to the shredder for further shredding so as to produce pieces of a more uniform size. More typically, the recycling assembly is located to one side of the shredder, preferably coaxially to one side. The recycling assembly is provided with means for transporting material to the shredder. More typically, the transporting means is a slide, baskets or similar for holding the severed material.

More typically, the recycling assembly is a trommel or trommel-like device which rotates to reintroduce cut pieces into the shredder. Even more typically, the trommel is a rotating wheel-like framework having baskets for transporting cut pieces back to the receiving hopper of the shredder. Even more typically, the trommel is located axially off-set or to one end of the shredder for introducing cut pieces to one region of the counter rotating cutters, preferably the portion of the array having cutters of reduced or relatively smaller widths, such as for example, from about 40 to 70 mm wide. More typically, the trommel is provided with a slide, preferably an adjustably movable slide for collecting and/or distributing material.

BRIEF DESCRIPTION OF THE DRAWINGS

The present invention will now be described by way of example with reference to the accompanying drawings in which.

DETAILED DESCRIPTION OF THE PREFERRED EMBODIMENT

Figure 1:
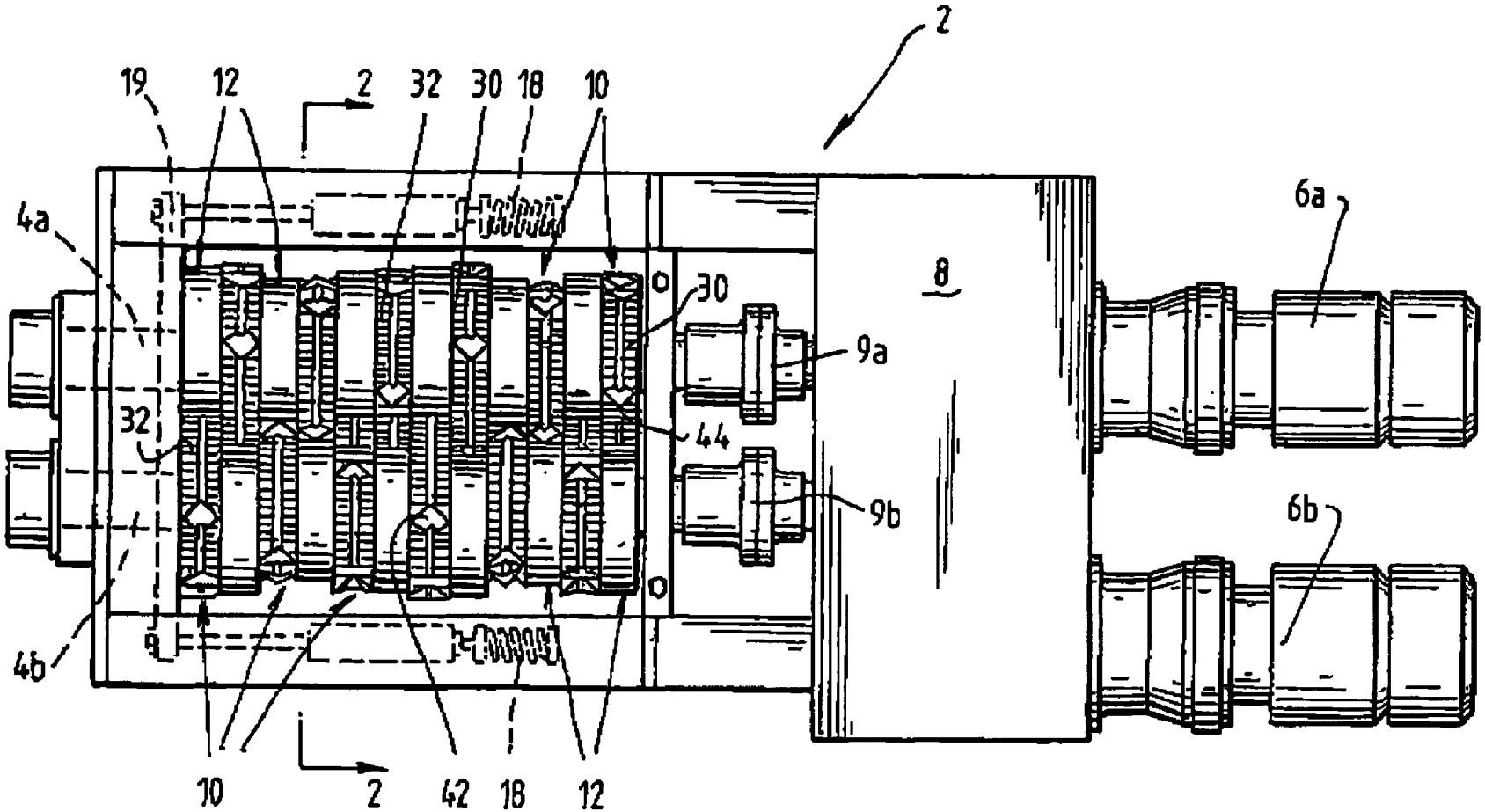
FIG. 1 is a top plan view of a shredder having one form of the cutting system of the present invention including two oppositely arranged rows of a plurality of cutters and spacer rings arranged alternately to each other along one row and opposite the other row.

In FIG. 1 there is shown one form of a shredder or shredding machine, generally denoted as 2, suitable for shredding used motor vehicle tires. Briefly, shredder 2 includes a pair of driven counter-rotating spaced apart shafts 4*a*,4*b* arranged in substantially parallel relationship to each other. Shafts 4*a*,4*b* are driven by suitable motors 6*a*,6*b* arranged in substantial parallel relationship through a suitable transmission 8, such as electric or hydraulic motors and mechanical gearboxes. Couplings 9*a*, 9*b* join shafts 4*a*, 4*b* to gearbox/transmission 8.

A plurality of rotary cutters 10 are located on one of the shafts 4*a* arranged alternately with a plurality of spacer rings 12 to form an alternating sequence of cutters 10 and spacers 12 in a row on this shaft. A second shaft 4*b* is also provided with a plurality of cutters 10 and spacers 12 alternately arranged thereon to also form an alternating sequence of cutters and spacers in a row. The cutters 10 on one shaft 4*a* are arranged to cooperate with cutters 10 on the other shaft 4*b* so that each cutter 10 is located between two adjacent spacers 12 on the one shaft and opposite a spacer ring 12 on the other shaft and, similarly, each spacer 12 is located between two adjacent cutters 10 on the one shaft and opposite a cutter 10 on the other shaft. Thus, an alternating array of cutters 10 and spacers 12 are formed on the two shafts in opposed facing relationship to each other to form the array of cutters and spacers as shown in FIG. 1 with the cutters arranged adjacently opposite each other. In operation, the shafts 4*a*,4*b* and cutters 10 are rotated in opposite directions, such as in the directions indicated by arrows A and B of FIG. 2, which directions are in a direction towards each other at the top of the array so that material fed to the top of the shredder in use is firstly grabbed by the cutters 10 as the cutters rotate in a direction towards each other at the top of the array and are sliced or otherwise cut into strips by passage between the pair of oppositely adjacent cutters as the cutters rotate in the same direction as each other before rotating away from each other at the bottom of the array to release the cut material allowing it to fall into a hopper or other receiving receptacle located at the bottom of the shredder or be directed to a suitable recycling means for reintroducing material into the shredder for further cutting.

The alternating array of cutters 10 and spacers 12 are held together in contact with each other at a predetermined tension by a suitable tensioning means. In one form the tension is applied by tension spring 18 located on each respective side of the array for applying a force to one end of the array through a suitable connector in the form of a thrust plate 19 or similar.

It is to be noted that each cutter 10 in each row of the array is identical to each other as is each spacer 12 in the array identical to each other. Accordingly, operation of the device by reference to two cutters and one spacer only will be described in detail in which the spacer is located adjacent one cutter and opposite the other cutter and the two cutters have side cutting surfaces facing each other which cooperate with each other to sever material located between them into strips.

Figure 8:
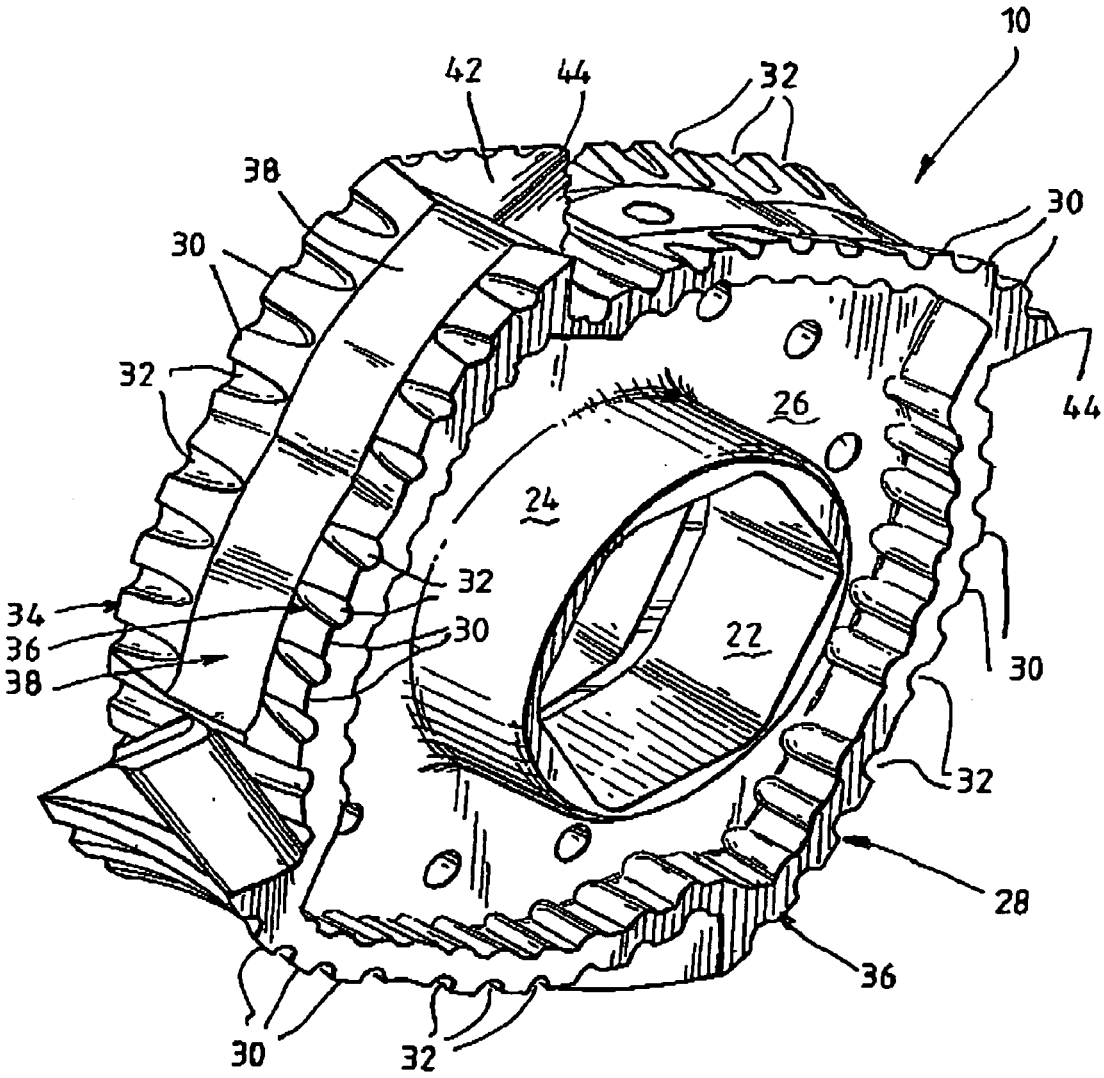
FIG. 8 is a side perspective view of another form of the cutter useful in the device of the present invention.

With particular reference to FIG. 8, in one form, cutter 10 is provided with a hexagonal centrally located aperture 22 through which is received a correspondingly sized hexagonal shaft 4. In use hexagonal shaft 4 is driven by motor 6 so as to rotate cutter 10. A flanged boss 24 is provided to surround hexagonal aperture 22 on each side of the cutter to provide a drive surface for shaft 4 and to provide a buffer to prevent two adjacent cutters 10 on the one row of cutters from being forced too close to each other to cause unnecessary wear of the respective cutting surfaces. The internal profile of boss 24 is hexagonal whilst the external profile is circular as shown in FIG. 8. It is to be noted that the length of boss 24 can vary according to the requirements and wear patterns of the cutters. In some cases boss 24 will be longer to maintain separation of adjacent cutters whereas in other embodiments boss 24 will be relatively shorter allowing the cutting surfaces of adjacent cutters to contact each other for longer periods of time.

The body of cutter 10 is a substantially circular disc 26 which is provided circumferentially around the external circumference of the circular profile of boss 24 to form a disc-like body for the cutter.

A cutting surface, generally denoted as 28, of the cutter 10 is provided around the circumference of the disc 26. Cutting surface 28 can take a variety of different forms, shapes or profiles. One such form of the cutting surface 28 is in the form of a substantially castellated surface comprising a plurality of raised substantially square profiled teeth 30 and a plurality of substantially curved or rounded troughs or grooves 32 arranged alternately with each other along each side edge of the cutting surface 28. The spacing between adjacent raised teeth may be regular, irregular, random or in any pattern or configuration. Teeth 30 and troughs 32 can take any suitable shape, profile or form.

In the embodiment shown in the drawings, particularly FIG. 8, the cutting surface 28 is formed of three sections when viewed transversely i.e., in cross-section in the axial direction of the cutter along the lengthwise extending axis of shaft 4 to which the cutter is fitted in use. The three sections include a first edge section 34 located at or towards one side edge of the cutting surface, a second edge section 36 located at or towards the other side edge of the cutting surface, and a central section 38 located intermediate the two edge sections. The central section 38 is in substantial alignment in the radial direction with the disc body 26 of the cutter. The first edge section 34 and the second edge sections 36 are each composed of substantially square profiled teeth 30 separated from each other by substantially rounded triangular cut-outs or troughs 32. Additionally, the teeth slope or are inclined outwardly from the centre line of the cutter in both the axial direction and the radial direction to form not only a gripping surface for material introduced into the shredder but also a cutting surface for material located between oppositely adjacent cutters.

The central section 38 is substantially smooth, being relatively free from indentations, projections or other surface irregularities, or surface discontinuities but is substantially undulating, over a portion of the circumference.

Figure 2:
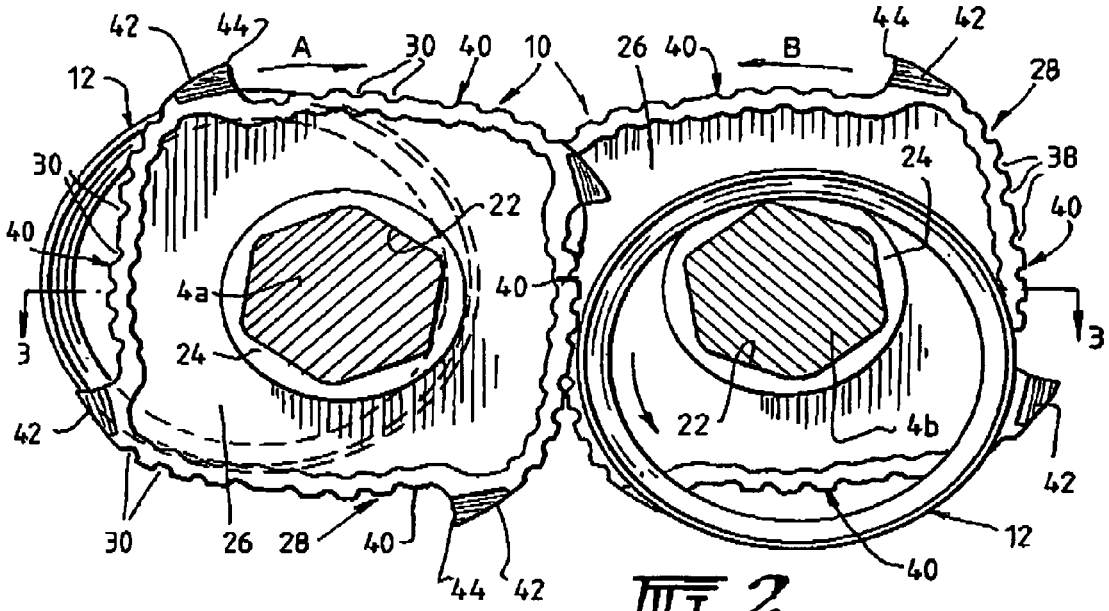
FIG. 2 is a partial vertical cross-section along the line 2 to 2 of FIG. 1 showing one form and arrangement of the cutter and spacer ring assembly of the present invention in one position of rotation.

Although the circumference of the cutter is described as being substantially circular, some embodiments of the cutter, such as shown in FIGS. 2 and 8 can be substantially square with rounded corners and/or slightly bulging sides or substantially circular with flattened segments, divided into four substantially identical surface sections 40 as shown more clearly in FIG. 2. A hook 42, spear, tip or similar is provided intermediate two adjacent sections 40 so that there are four hooks 42 located at regular spaced apart locations around the surface so as to divide the cutting surface into the four identical sections 40 as indicated particularly in FIG. 2.

Hook 42 can take any number of different forms. One such form has the appearance of a shark fin in profile when viewed as a side elevation view. However, when viewed end-on the distal end of hook 42 is spear-like in appearance having two oppositely inclined cutting blades terminating in a point so as to form a spear tip or spear head or spear-like projection 44. The sharp end or tip 44 of hook 42 punctures any material introduced into the shredder to hold the material onto the cutter and prevent it from being dislodged between the cutters when being cut or shredded by the two oppositely rotating cutters.

A second boss 24, similar to the first flanged boss 24 is also provided on the other side of the disc-like body 26 to also act as a buffer by contacting the corresponding boss of the cutter located adjacent to this cutter on the shaft to prevent the cutting surfaces 34,38 of one cutter 10 from wearing against the cutting surfaces 34,38 of an adjacent cutter thereby preventing premature wearing of the cutting surfaces 34,38 of both cutters. However, different arrangements of bosses are also within the scope of this invention.

Figure 4:
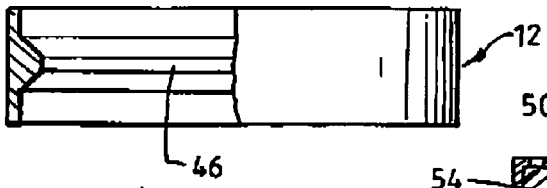
FIG. 4 is a partial cross-section view through one form of the spacer ring and a partial side view of the circumference of the side ring.

Spacer ring 12 can take many different forms and/or internal profiles and be of many different shapes and/or sizes. With particular reference to FIG. 4, one form of spacer ring will now be described. In this form outer circumferential surface of ring 12 is smooth and the ring is of a diameter which is about the same as or similar to the internal diameter of the cutting surface 34, 38 of the cutter. Ring 12 is provided with a radially inwardly directed flange portion 46 in the shape of a T-section when viewed in cross-section extending radially inwards from the inner surface of the circumferential portion or surface of the ring. Other internal profiles of the flange or similar reinforcing arrangement are possible.

Figure 7:
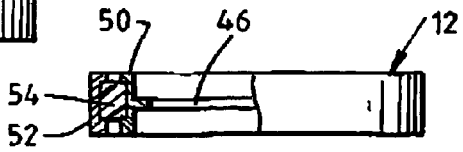
FIG. 7 is a partial side view and a partial cross-sectional view of another form of the spacer of the present invention.

With particular reference to FIG. 7, another embodiment of spacer ring 12 will now be described. This form of spacer 12 is provided with an inner ring surface portion 50 having a T-shaped radially inwardly flange 46 and an outer annular ring portion 52. A groove is provided in the outer surface of inner ring 50 and another groove is provided in the inner surface of outer ring 52 in opposed face to face relationship to each other substantially in alignment with each other. An annular ring or 'O '-ring 54 or similar forming a circular pad or loop of substantially resilient material is located intermediate the inner ring 50 and the outer ring 52 in the oppositely facing grooves.

In use, the resilient pad 54 acts as a cushion between the outer ring portion 52 and inner ring portion 50 to soften the effects of the hits or blows on the outer surface of outer ring 52 by hook 42, particularly tip 44, in use of the shredder as will be described in more detail later in this specification.

Figure 3:
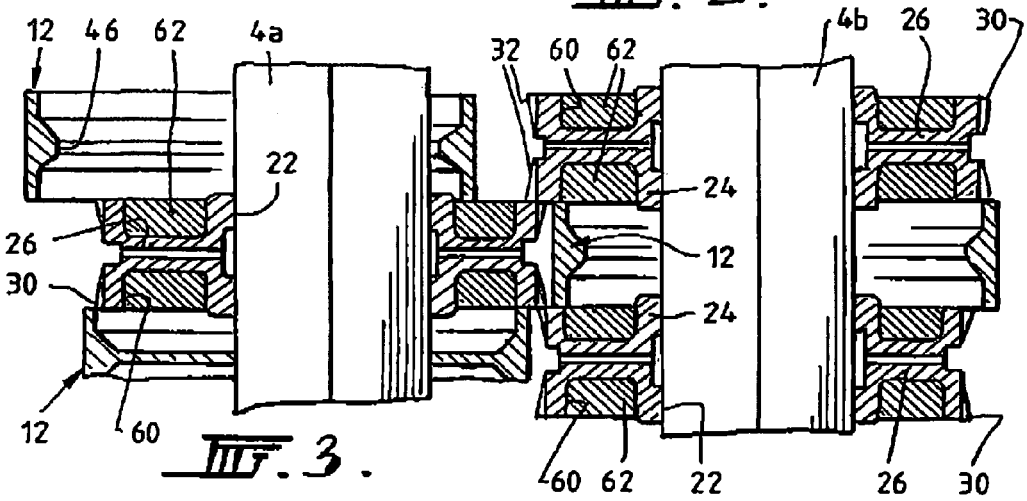
FIG. 3 is a more detailed close-up cross-section view of the arrangement of the cutters and spacer rings along the line 3 to 3 of FIG. 2.

Returning now to the description of the cutters, in other embodiments of the cutters, modifications are provided to the disc-like bodies 26 of the cutters as shown in FIG. 3. In one embodiment the axially outwardly facing side surfaces of the body discs 26 are provided with groove 60 having a substantially square or rectalinear profile located on either side of the disc body 26. Rings made from material different to the material from which the cutters are made are provided in these annular grooves to act as sacrificial wear surfaces which wear in preference to the cutting surfaces of the cutter wearing which is caused by constant rubbing against the spacers during use of the shredder. In the embodiment of FIG. 3 sacrificial wear rings 62 are made from any suitable wearing material, such as for example, metal, plastics material or the like. One preferred material is a metal at least as hard as the metal from which the cutter itself is made, such as a hard wearing steel or similar. In still other embodiments, the cutters can be made with integrated rings or inserts made from the same material as the cutters by being cast or similar when the cutters are being manufactured.

Another form of the cutter is provided with a loop of resilient material on either side of the cutter in place of or next to the wear ring or wear segments or blocks. The loop is made from plastically deformable material or other readily compressible material to act as a sound deadening material so as to reduce the noise of the spacer ring rubbing against the side of the cutters or the cutters rotating against each other. In one form, the resilient material is a foamed material or is a foam, such as for example, similar to a natural or synthetic chamois or similar material. It is to be noted that during use of the shredder, the rings move past and beyond the periphery of the cutters, particularly past or beyond the hook of the cutters to completely clean the cutters by completely dislodging material from adhering to or being retained on the cutters particularly dislodging material caught or impaled on the hook.

Figure 5:
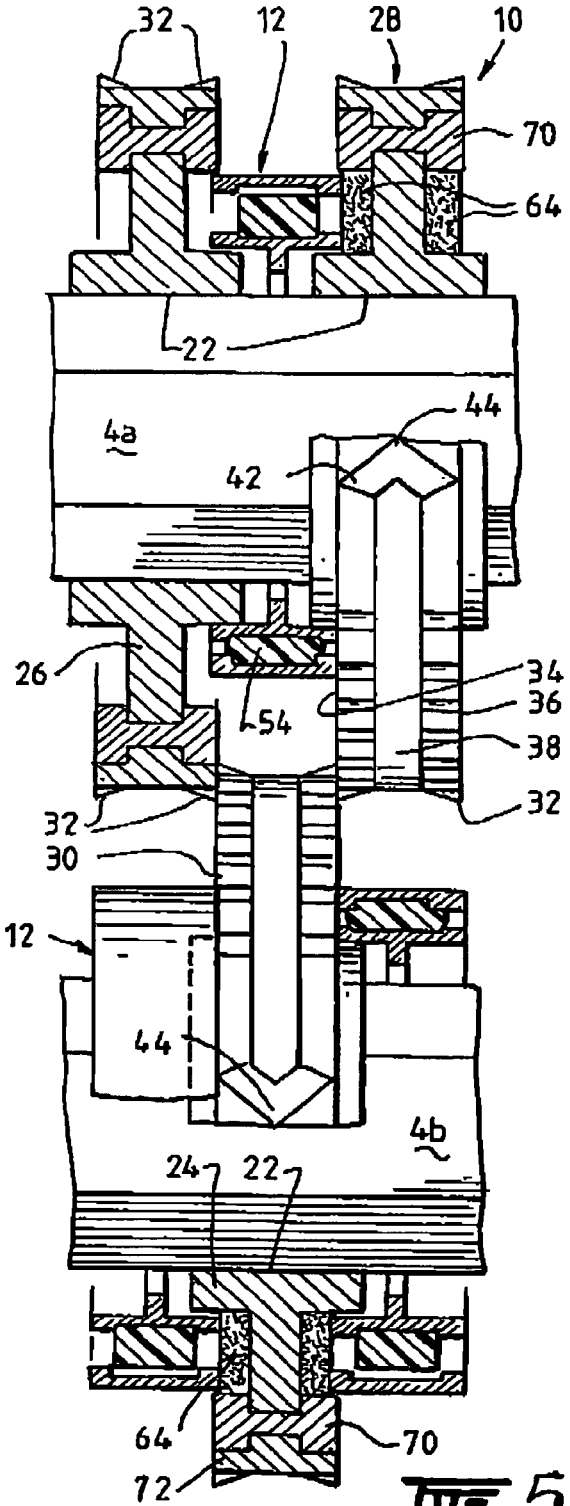
FIG. 5 is a more detailed close-up cross-section view similar to FIG. 3 of an alternative form of the cutter and spacer ring arrangement of the present invention in one position of rotation.
Figure 6:
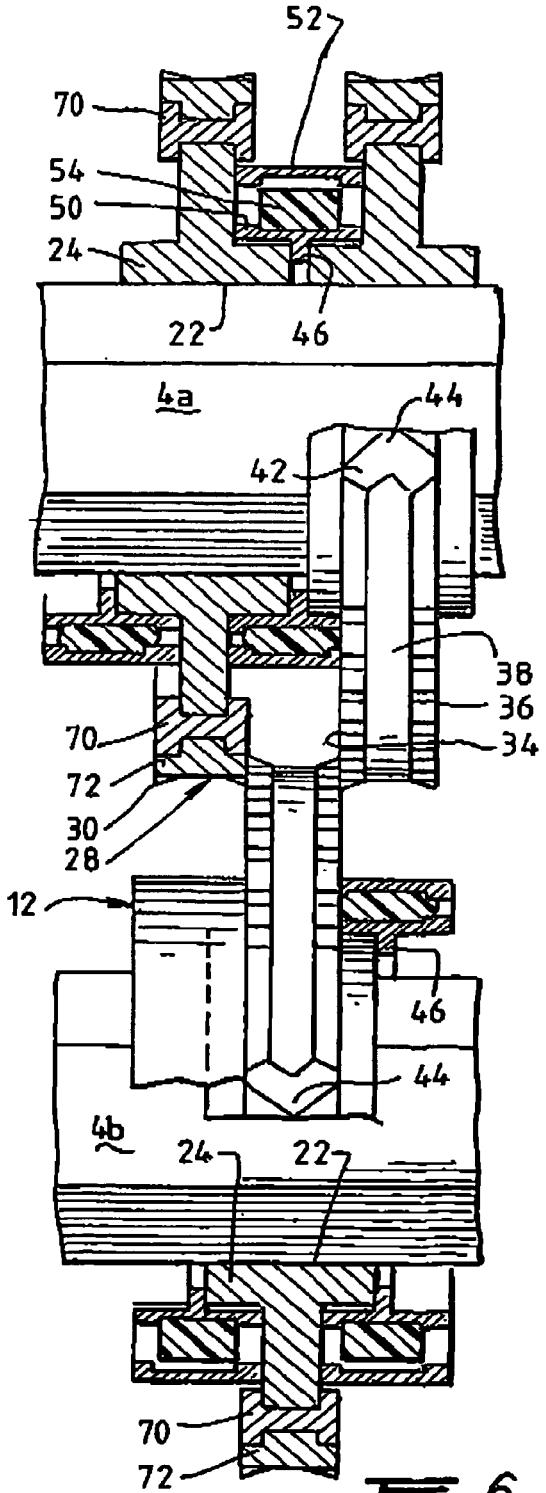
FIG. 6 is a more detailed close-up cross-section view similar to FIG. 3 of a still further embodiment of the cutter and spacer ring arrangement of the present invention in one position of rotation.

In a still further modification of the cutters of the present invention as shown in FIGS. 5 and 6, the cutters 10 are made in a composite or laminate structure in which different sections of the cutter 10 can be made from different materials in different arrangements. In one embodiment, shown in FIG. 5, the inner part of the cutter which is the disc like body 26 is made from one material, such as for example, cast iron, steel or the like. An annular ring 64 or 'O'-ring or similar is made from a resilient material or at least a 'softer' material than the body 26 of the cutter and is provided in annular grooves on either side of the iron or steel disc forming the body 26 of the cutter to act as a wear surface or to provide greater sealing between the adjacent cutter and spacer so as to prevent debris, severed material or the like from lodging next to the cutter near the driving shaft 4 or falling through the device and becoming entrapped around the rotating shaft.

In other embodiments as shown in FIG. 6 and also one of the cutters of FIG. 5 the 'O'-ring 64 or similar is omitted.

In both embodiments shown in FIGS. 5 and 6 an intermediate ring 70 of a different material is provided radially outwardly of and around the circumference of the disc-like body 26. Intermediate ring 70 in one form, has a substantially H-shaped profile when viewed in transverse cross-section as shown in FIGS. 5 and 6.

In this embodiment there is an outer ring 72 which forms the cutting surface 28 having teeth 30 for cutting and gripping materials fed into the shredder for cutting between the adjacent cutters 10.

Further it is to be noted that the one shredder may have a mixture of different types of cutters ranging from (i) a one-piece cast iron or steel cutter with the cutting surface 28 formed on the outer periphery of the cutter, (ii) a cutter having an intermediate ring 70 between the body 26 and the outer ring 72 in which the outer ring 72 forms the cutting surface 28 to (iii) a cutter having an inner ring 64 of resilient or wear material in addition to an intermediate ring 70 and an outer ring 72 which forms the cutting surface 28 and to (iv) a cutter having a pair of foam loops, one on either side of the cutter for absorbing sound of the impact of the cutter. It is to be noted that whatever form or construction the cutter takes, the outer ring 72 is always provided with the cutting surface 28 comprising the projections, teeth 30, hooks 42, spear tips 44, or the like for holding, puncturing, slicing, cutting of the like the material fed to the shredder.

The shredder of the present invention is provided with an optional feature which is a trommel or trommel-like assembly for recycling partially cut material back into the shredder. In one form, the trommel-like device is in the form of a large wheel like framework having baskets or similar receiving or guiding means for receiving and directing the partially severed lumps of tyre back into the shredder to be recycled through the cutting array. The recycling trommel is located axially to one side of the shredder for recycling partially cut material back to the hopper of the shredder for a further pass through the shredder.

Operation of one form of the shredder will now be described.

Shredder 2 is operated by driving the two rotating shafts 4*a*, 4*b* in unison in different directions by operation of the motors 6 provided for this purpose. In FIG. 1, it is noted that the spear heads 44 of hooks 42 point in the direction of rotation of the shafts 4 and of the two rows of cutters 10. Thus, when viewed from above as in FIG. 1 the respective top surfaces of the two rows of cutters rotate towards each other to force material down in between the cutters as they rotate.

When material is introduced into the shredder 2, the teeth 30 of the outer cutting surface 28 of the cutters 10 firstly grab the material and draw it into the area between the two rows of cutters and then when the material is located between a pair of oppositely adjacent cutters the material is cut into strips by the cooperating action of the opposed cutting edges 34,38 of the two oppositely adjacent cutters. The strip of material is then dragged by the teeth 30 from between the two rows of cutters by rotation of the cutters to fall into a hopper or similar container provided underneath the cutting assembly or array of cutters in the device or into a slide to direct the material into the trommel.

Hooks 42 assist in holding the material between the cutters and prevent it from being dislodged by tips 44 puncturing the material to securely retain it from being squeezed out of the counter-rotating cutters. As one preferred material being shredded by the shredder of the present invention is rubber, particularly used vehicle tires, there is a tendency for the cut rubber strips to curl around the cutters and become wound around the cutters and shafts thereby becoming entangled in the array of cutters with the effect that the shredder either stops working or the efficiency of operation of the shredder is greatly reduced. By having the spacer rings 12 located on either side of each cutter, the cut strips of rubber tires are prevented from wrapping around the shafts and cutters thereby maintaining the cutting assembly substantially free of debris and allowing it to continue operating efficiently. Additionally, the spacer rings can be pushed away from engagement with the adjacent or opposite cutters to leave a gap or space to allow foreign objects to pass between the two rows of rotating cutters and to fall into the collection hopper under the cutting assembly hereby reducing the chance of the cutters being damaged by impacting against the foreign objects particularly if the foreign objects are hard.

Each spacer ring 12 is free to move with respect to its shaft depending upon the forces and the direction of the forces acting on the particular ring since it is not mounted on the shaft in driving connection therewith but rather is freely located on the shaft and is able to move eccentrically about the shaft with a combination of rotary and linear movements.

As one pair of adjacent cutters rotate the spacer ring located between them also rotates accordingly since, in effect, the spacer is sandwiched or clamped between the two cutters. The spacer undergoes a rotation in a generally circular path in accordance with the regular rotary movement of the two cutters on either side of the spacer ring.

However, as the cutters rotate, particularly the cutter directly opposite the spacer ring 12 being described, the hooks 42 of this opposite cutter also rotate and as the hooks 42 extend radially outwards of the remaining part of the cutting surface 28 of the opposite cutter, the hooks 42, particularly tips 44, come into contact with the outer circumference 72 of the spacer ring located directly opposite this cutter which forces the spacer ring 12 to be radially or linearly displaced with respect to the shaft 4 so that the inner surface of the spacer ring contacts the combined outer surface of the perspective bosses 24 of the adjacent cutters to retain the spacers of the shaft but in a displaced position as compared to the position that it would have adopted under normal rotation by the two adjacent cutters if not struck by the opposite cutter as it rotates. Thus, as the cutters rotate, the spacer rings that are located directly opposite each cutter are being continually knocked sideways along and against the sides of the cutters, i.e., the spacers are being pushed substantially radially with the effect that the actual movement of the spacer rings is eccentric being a combination of rotary movement and radial movement, i.e., substantially repeatedly eccentric. For each revolution of an opposite cutter the spacer ring is knocked sideways four times along the side of the cutter because the cutter has four hooks 42 and tips 44. Thus, the spacer undergoes two simultaneous movements, in operation, being knocked sideways at it rotates. This occurs four times per each revolution of the cutter.

The effect of the transverse movement of the spacer ring as it rotates is to knock the tire strips curling around the cutters and shafts away from the cutting surface of the cutters and the cutters themselves thus cleaning the cutters and clearing any debris or strips of cut material away from the cutters which prevents the rubber strips from wrapping around the cutters, ie the strips are knocked away from the cutters before they have a chance to wind around the rotating cutters. It is to be noted that the extent of movement of the spacer ring is such that it extends beyond the end of the hook projections when hit by the opposite cutter so as to dislodge any material retained on the hook thereby cleaning the cutter. Thus, the linear movement of the spacer ring is greater than the radius of the widest point of the cutter.

If fitted, the recycling trommel picks up relatively larger sized pieces of shredded material or uncut strips in the rotating baskets or similar provided on the wheel-like rotating framework and transports these pieces back to the inlet of the shredder for further shredding by being passed through the shredder again.

In one embodiment, the recycling mechanism includes a slide for directing partially cut material from the shredder to the trommel and/or another slide for directing material from the trommel back into the inlet of the shredder. In other embodiments the slide is stationary or is movably adjustable or is regularly repeatedly movable so as to distribute material more uniformly. The slide is provided to one side of the trommel so as to direct pieces to the centre of the trommel where they can be transported back to the inlet of the shredder. Other arrangements of the trommel arrangement are possible.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

Advantages of the present invention include that the cutting assemblies are substantially self cleaning and/or self clearing by the eccentric movement of the spacer with respect to the cutter which has the effect of increasing the effective working life of the cutting assembly by keeping the cutting surfaces, blades and the like of the cutters sharper for longer periods of time.

The invention claimed is:

1. A self sharpening shredding assembly for shredding material introduced into the assembly comprising a first driven cutter having an integral first cutting surface provided on a first shaft for rotation in a first rotary direction, and a second driven cutter having an integral second cutting surface mounted on the second shaft for rotation in an opposite direction to the first cutter where said first and second cutters are located adjacently opposite each other on different shafts so that at least a part of the first cutting surface is in rubbing contact with at least a part of the second cutting surface as the two cutters counter-rotate with respect to each other, said cutters on their respective shafts being urged together to maintain part of the first cutting surface in rubbing contact with a part of the second cutting surface so that material introduced into the cutting assembly between the first and second cutters is cut into smaller pieces by the two cutting surfaces rubbing against one another as the two cutters counter-rotate, said assembly including a cleaning ring mounted on the first shaft adjacent the first cutter and located opposite the second cutter on the second shaft for undergoing an eccentric movement comprising a combination of a first component of movement and a second component of movement wherein rotation of the first cutter imparts the first component of movement to the cleaning ring being a rotary movement and rotation of the second cutter to periodically contact the cleaning ring imparts a second component of movement being essentially a linear movement so that the eccentric movement is a combination of the rotary movement and the linear movement, said cutters being made from a material that is more wear resistant than is the material from which the cleaning ring is made so that as the cleaning ring rubs against the side of the first cutter, the cleaning ring wears in preference to the cutter wearing so that the rubbing movement of the cleaning ring against the cutter keeps the cutter free of debris and maintains the cutting surface in a sharp condition.

2. A self sharpening shredding assembly according to claim 1 in which the cleaning ring acts as a spacer between two adjacent first cutters on the first shaft to keep the two first cutters spaced apart from each other to a predetermined distance or spacing wherein the width of the spacer is at most equal to or less than the width of the cutter opposite.

3. A self sharpening shredding assembly according to claim 2 in which the cleaning ring moves against and along the side of the cutter.

4. A self sharpening shredding assembly according to claim 1 in which the cutter is provided with a wear portion which wears preferentially to the cutting surface as the cleaning ring rubs against the cutter.

5. A self sharpening shredding assembly according to claim 4 in which the side of the cutter is provided with a groove or rebate having a substantially square or rectilinear profile located on either side of the cutter for receiving therein the wear portion.

6. A self sharpening shredding assembly according to claim 5 in which the wear portion is an inner ring made from a material that is different to the material from which the cutter is made so as to act as a sacrificial wear surface which wears in preference to the cutting surface of the cutter wherein the wear portion is a continuous ring or a segmented ring in the form of spaced apart blocks arranged in a circle.

7. A self sharpening shredding assembly according to claim 6 in which the sacrificial wear portion is made from a metal or plastics material in which the metal is at most as hard as a metal from which the cutter itself is made so as to wear preferentially to the cutter.

8. A self sharpening shredding assembly according to claim 7 in which the cutter is made from a composite or laminate structure in which different sections of the laminate or composite cutter are made from different materials.

9. A self sharpening shredding assembly according to claim 8 in which the cutter comprises an inner portion in the form of a disc forming the body of a cutter made from steel or cast iron, an intermediate ring portion and an outer ring portion having the cutting surface in which the outer ring portion surrounds the inner ring portion.

10. A self sharpening shredding assembly according to claim 9 in which the intermediate ring of the cutter is made from a different material to the material of the outer portion surrounding the inner portion.

11. A self sharpening shredding assembly according to claim 8 in which the intermediate ring has a substantially H-shaped profile having an outer groove and an inner groove when viewed in transverse cross-section in which the disc of the body of the cutter is located in the inner groove of the intermediate ring.

12. A self sharpening shredding assembly according to claim 11 in which the wear portion is located radially inboard of the H-shaped intermediate ring.

13. A self sharpening shredding assembly according to claim 6 in which the cutter further comprises a loop of resilient material located on either side of the cutter in place of or next to the wear ring or wear segments.

14. A self sharpening shredding assembly according to claim 13 in which the loop is made from resilient material or plastically deformable material or other readily compressible material to act as a sound deadening material so as to reduce the noise of the spacer ring rubbing against the side of the cutter.

15. A self sharpening shredding assembly according to claim 13 in which the resilient material is a foamed material or is a foam.

16. A self sharpening shredding assembly according to claim 6 in which the extent of linear movement of the cleaning ring caused by contact with the second cutter is such so that the inner surface of the cleaning ring extends beyond the outer cutting surface of the first cutter.

17. A self sharpening shredding assembly according to claim 1 in which the cleaning ring is provided with a radially inner portion and a radially outer portion in which the radially outer portion is a sacrificial wear portion for wearing in preference to wearing of the cutting surface of the adjacent cutter as the cleaning ring rubs against the cutter.

18. A self sharpening shredding assembly according to claim 17 in which the inner portion of the cleaning ring is in the form of a ring having a T-shaped cross-section in which the stem of the T-shape is inwardly radially directed to the shaft on which the ring is mounted for eccentric movement.

19. A self sharpening shredding assembly according to claim 18 wherein the outer surface of the cleaning ring is contacted by the tip of the projection or projections provided on the opposite cutter.

20. A self sharpening shredding assembly according to claim 1 in which there is a multitude of the first cutters each having respective first cuffing surfaces located on the first shaft in alternating relationship with a multitude of the cleaning rings located on the first shaft and there is a multitude of the second cutters each having respective second cutting surfaces located on the second shaft in alternating relationship with a multitude of the cleaning rings on the second shaft, said multitude of first cutters intermeshed with the multitude of second cutters to form an array of alternately arranged first and second cutters with the cleaning rings located therebetween in which a part of the cuffing surface of each cutter on one shaft is in contact with a part of the cuffing surface of each adjacent cutter on the other shaft and the cleaning rings on one shaft are located opposite the cutters on the other shaft arranged so that the cleaning rings rub against the cutters on either side of the same shaft and are struck by the opposite cutter on the other shaft as the assembly counter-rotates wherein the rubbing movement of the cleaning rings keeps the cutters clean and sharpens the cutting surfaces of the cutters.

21. A self sharpening cutting assembly according to claim 20 wherein the cutting surface includes surface irregularities or discontinuities in which the irregularities or discontinuities are teeth, grooves, cleats, recesses, rebates, spaces, gaps or projections.

22. A self sharpening cuffing assembly according to claim 21, wherein the cuffing surface is provided with a retainer for retaining the material introduced into the cutting assembly between the cutters to assist cutting of the material located between the cutters by reducing the tendency of the material introduced into the assembly to be squeezed out from being between the cutters prior to passing through the cutters to be cut into the smaller pieces.

23. A self sharpening cutting assembly according to claim 22, wherein the retainer is a hook, enlarged teeth, projection, spearhead, tip, nose, finger or other protuberance.

24. A self sharpening cutting assembly according to claim 23 in which there is two or more projections located at spaced apart intervals around the circumference of the cutting surface of the cutters.

25. A self sharpening shredding assembly according to claim 24 in which the cutting surfaces of adjacently opposite cutters are in edge to edge contact and the cutting surface is integral with the cutter arranged so that the surface provided on the cutter includes two cutting edges located at either side of the cutter and a central section located between the two side edges so that the side edge of one cutting surface is in contact with the side edge of the oppositely adjacent cutter.

26. A self sharpening shredding assembly according to claim 25 in which two or more projections located on the central section of the cutting surface between either side edge and extend radially outwardly from the cutter surface.

27. A self sharpening shredding assembly according to claim 1 wherein the cleaning ring has a reinforcing, internally located, radially directed flange, and an outer circumferential surface for contact by the cutting surfaces of the oppositely located cutter.

28. A self sharpening shredding assembly according to claim 27 wherein the cleaning ring includes an inner ring in the form of the T-shape flange, an intermediate ring and an outer ring, in which the intermediate ring is located between the radial outer part and the radial inner part and is made from a resilient material.

29. A self sharpening shredding assembly according to claim 1 wherein the linear movement is superposed on the rotary movement of the cleaning ring repeatedly for each revolution of the cleaning ring to form the eccentric movement.

30. A self sharpening shredding assembly according to claim 29 in which the extent of linear movement of the cleaning ring caused by contact with the second cutter is such so that the ring extends beyond the tip of the projection of the first cutter.

31. A self sharpening shredding assembly according to claim 30 in which the number of linear movements imparted to the cleaning ring by the second cutter is in accordance with the number of projections provided on the second cutter.

32. A self sharpening shredding assembly according to claim 31 in which each of the cutters is provided with four projections generally regularly spaced apart around the circumference of the cutter.

33. A self sharpening shredding assembly according to claim 1 in which said first and second shafts rotate in opposite direction at the same speed or at different speeds depending on the use and type of material being shredded.

* * * * *